US005487860A

United States Patent [19]

Kent et al.

[11] Patent Number: 5,487,860

[45] Date of Patent: Jan. 30, 1996

[54] CONTINUOUS PROCESS FOR SPINNING AND DRAWING POLYAMIDE AND APPARATUS THEREOF

[75] Inventors: George M. Kent, Arden, N.C.; Ardy Armen, Anderson, S.C.

[73] Assignee: BASF Corporation, Parsippany, N.J.

[21] Appl. No.: 321,471

[22] Filed: Oct. 11, 1994

Related U.S. Application Data

[63] Continuation of Ser. No. 860,658, Apr. 30, 1992, abandoned.

[51] Int. Cl.[6] ..... D01D 10/02; D01F 6/60

[52] U.S. Cl. ..... 264/103; 57/287; 57/310; 57/350; 264/168; 264/210.3; 264/210.5; 264/210.8; 264/211.15; 264/211.17; 264/345; 425/66; 425/71; 425/72.2; 425/104; 425/445

[58] Field of Search ..... 264/103, 129, 264/130, 168, 210.3, 210.5, 210.8, 211.15, 211.17, 345; 425/66, 71, 72.2, 104, 445; 57/287, 310, 350

[56] References Cited

U.S. PATENT DOCUMENTS

| | | | |
|---|---|---|---|
| 2,289,860 | 7/1942 | Babcock | 264/211.17 |
| 3,039,171 | 6/1962 | Hume et al. . | |
| 3,414,646 | 12/1968 | Pitzl | 264/210.5 |
| 3,550,369 | 12/1970 | Pitzl . | |
| 3,761,556 | 9/1973 | Thom et al. | 264/168 X |
| 4,396,570 | 8/1983 | Peckinpaugh et al. | 264/210.3 |
| 4,456,575 | 6/1984 | Smith et al. | 264/211.17 |
| 4,522,774 | 6/1985 | Donnelly et al. . | |
| 4,539,170 | 9/1985 | Hare . | |
| 4,631,162 | 12/1986 | Yoshimoto et al. . . | |
| 4,702,875 | 10/1987 | Jennings . | |
| 4,721,650 | 1/1988 | Nunning et al. . | |
| 5,019,316 | 5/1991 | Ueda et al. | 264/210.8 X |

FOREIGN PATENT DOCUMENTS

| | | | |
|---|---|---|---|
| 62-238814 | 10/1987 | Japan | 264/210.3 |
| 616181 | 3/1980 | Switzerland . | |

OTHER PUBLICATIONS

Translation of Japan 62–238,814 (Published Oct. 1987).

*Primary Examiner*—Leo B. Tentoni
*Attorney, Agent, or Firm*—Nixon & Vanderhye

[57] ABSTRACT

A continuous process for spinning and drawing polyamide filaments with the steps of melting a polyamide and spinning the filaments from the molten polyamide through a spinnerette, quenching the filaments, applying a yarn finish to the filaments, applying steam and heat to the filaments by a steam and heating unit which consists of a steam box and at least one heated godet, drawing the filaments, and optionally texturing the filaments. The resulting filaments have low shrinkage, high crystallinity, and a high percentage of alpha crystals.

31 Claims, 2 Drawing Sheets

CONTINUOUS PROCESS FOR SPINNING AND DRAWING POLYAMIDE AND APPARATUS THEREOF

This is a continuation of application Ser. No. 07/860,658, filed Apr. 30, 1992, now abandoned.

BACKGROUND OF THE INVENTION

Polyamide yarns are commonly produced by melt spinning of one or of a plurality of filaments which are wound onto a container, stored for some time, sometimes referred to as lagging time, and subsequently in a second step drawn and textured. This two-step process produces a yarn with a high crystallinity and a low shrinkage. In addition, a high percentage of the crystals in the two-step yarn are the alpha-type which are more stable than the gamma-type crystals.

One step processes, often referred to as spin-draw-texture (SDT) processes, have been developed which are more efficient but which produce yarns with lower crystallinity and higher shrinkage during the heatsetting process. In addition, these yarns contain a lower percentage of the stable alpha crystals than two-step yarns. The disadvantages of these yarns are the differing deniers of comparable heatset products.

Another disadvantage is the very smooth surface of these yarns which leads to high yarn-to-guide friction in processing the yarns into fabrics which show undesirable non-uniformities such as streaks.

To overcome this latter problem, U.S. Pat. No. 3,414,646 describes a process for the production of polycarbonamide filaments using a treatment of the filaments with steam before the drawing step.

U.S. Pat. No. 3,761,556 discloses a process for the manufacture of a crimped polyamide yarn including a two-stage steaming process prior to drawing and crimping.

In order to improve ozone fading resistance of dyed nylon yarn, U.S. Pat. No. 4,396,570 describes a continuous process for spinning and drawing nylon 6 filaments by applying steam in a chamber to the filaments before the drawing step.

An object of the present invention was to provide a continuous process for spinning and drawing polyamide for the manufacture of polyamide yarns with a high crystallinity, a higher percentage of alpha crystals, and a low shrinkage. Another object was to provide an apparatus for such a process.

SUMMARY OF THE INVENTION

The objects of the present invention could be achieved with a continuous process for spinning and drawing polyamide filaments comprising:

(a) melting a polyamide and spinning the filaments from the molten polyamide through a spinnerette;

(b) quenching the filaments;

(c) applying a yarn finish to the filaments, (d) applying steam and heat to the filaments by a steam and heating unit comprising a steam box and at least one heated godet;

(e) drawing the filaments; and optionally (f) texturing the filaments.

DETAILED DESCRIPTION OF THE INVENTION

Continuous processes for spinning and drawing polyamide filaments are known, for example, from U.S. Pat. Nos. 3,414,646; 3,761,556 and 4,396,570, hereby incorporated by reference.

Polyamides are well known under the generic term "nylon" and are long chain synthetic polymeric amides. Nylons are identified by the number of atoms in the diamine and dibasic acid, for example nylon 6/6, which stands for a polymer formed by the condensation of hexamethylene diamine and adipic acid. Other nylons are formed from only one reactive species such as an aminoacid or a lactam. Polyaminocaproic acid is produced by the polymerization of caprolactam and is known as "nylon 6". Commercially available and useful for the purpose of this invention are all linear melt-spinnable polyamides. Preferred for the purpose of this invention are nylon 6, nylon 66, nylon 6/10, nylon 6/12, nylon 11, nylon 12, nylon 66T, nylon 6I6T, copolymers thereof, or mixtures thereof, and especially preferred is nylon 6.

In step (a) the polyamide is melted in an extruder and spun through a spinnerette to form filaments. These filaments are quenched in step (b) with a flowing quench medium such as air.

In step (c) a yarn finish is applied to the filament as 100% oil or as an aqueous emulsion containing from 5 to 30% finish solids. The finish could be metered onto the fiber or applied with a kiss roll. Suitable finishes could contain the following components: esters, vegetable oils, alkoxylated vegetables oils, alkoxylated acids, alkoxylated diacids, alkoxylated sorbitol esters, alkoxylated sorbitans, alkoxylated alkyl phenols, and phosphate esters. Preferred finishes contain vegetable oils, alkoxylated diacids, and phosphate esters or contain esters, vegetable oils, alkoxylated vegetable oils, alkoxylated alkyl phenols, and phosphate esters.

Steam and heat are applied to the filaments in step (d) by a steam and heating unit comprising a steam box and at least one heated godet. Steam is applied to the filaments by a steam box with a steam temperature of from about 60° C. to about 180° C., preferably from about 100° C. to about 150° C. and most preferably from about 120° C. to about 140° C.

In a preferred embodiment the filaments pass the steam box on the outside, where the steam box releases the steam out of individual steam applicator jets having a diameter of from about 0.1 to about 2.0 mm, preferably from about 0.5 to about 1.0 mm.

In a preferred embodiment, the number of applicator jets corresponds with the number of steps in the stepped-out godet used in step (d).

Preferably the steam box is located between two godets.

The jets releasing the steam are preferably on both sides of the steam box, where the steam is applied to the passing filaments. For a better alignment of the filaments in order to pass the jets, the jets of the steam box are Located in slots. The advantage of this steam box is that there arise no problems with condensing water because the steam is released in the air and evaporates. The water, condensed in the steam box is separated by an exhaust pipe. In embodiments where the filaments pass inside the steam box, problems always arise with the condensation of water on the filaments.

In step (d) preferably two godets are used, at least one of which could be heated. The godets may be heated electrically or with steam to a temperature of from about 60° C. to about 180° C., preferably from about 100° C. to about 160° C. and most preferably from about 120° C. to about 160° C.

The filaments wrap from about 1 to about 50 times around the two godets and the steam box, preferably from about 5 to about 30 times, most preferably from about 10 to about 20 times.

During this heat application the filaments elongate from about 10 to about 20%. In order to adjust this elongation to the size of the godets, a preferred embodiment of this invention uses at least one stepped-out godet. The stepped-out godet has preferably as many steps as wraps of the filaments which may be from about 1 to about 50, preferably from about 5 to about 30, most preferably from about 10 to about 20 steps.

In order to reduce any kind of friction, preferably two stepped-out godets are used with a difference in diameter from step to step from about 0.2 to about 10%, or double this value in the case that only one stepped-out godet is used.

More than two godets could be used but it is less desirable. More than one steam box could be be used but this is also less desirable.

Based on a speed of the filaments of from about 5 to 40 m/s, preferably from about 10 to about 20 m/s, the residence time in the steam and heating unit is from about 1 to about 9 s, preferably from about 2 to about 4 s.

The drawing step (e) is conducted with a drawing godet which could be heated, and a draw ratio of from about 1.1 to about 5.0, preferably from about 2.0 to about 4.0.

The optional texturing step (f) is known in the art and may utilize steam, air, hot air, solvent, water, crimping rolls, and the like. Preferred is the use of a texturing jet utilizing steam or hot air.

Determining the percentages of alpha and gamma crystals in the crystalline phase of a nylon 6 fiber is known in the art, and an excellent reference is R. F. Stepaniak, A. Garton, D. J. Carisson, and E. S. Clark, Journal of Applied Polymer Science, vol. 21, p. 2341 (1977). Determining the percent crystallinity in a nylon fiber is well known in art and is typically calculated from the measured fiber density and the intrinsic density values for the amorphous and crystalline phases.

The filaments produced by this process show a Superba shrinkage, measured in a 129° C. tunnel, of from about 18 to 20% in comparison to about 25 to 28% for filaments without this steam and heating treatment. With emulsion finish and this treatment the shrinkage was reduced below 18%. Superba shrinkage measured in a 117° C. tunnel dropped from about 17–19% for the untreated filaments to about 9 to 12% for the filaments produced by the process of the present invention.

DETAILED DESCRIPTION OF THE DRAWINGS

Figure 1:
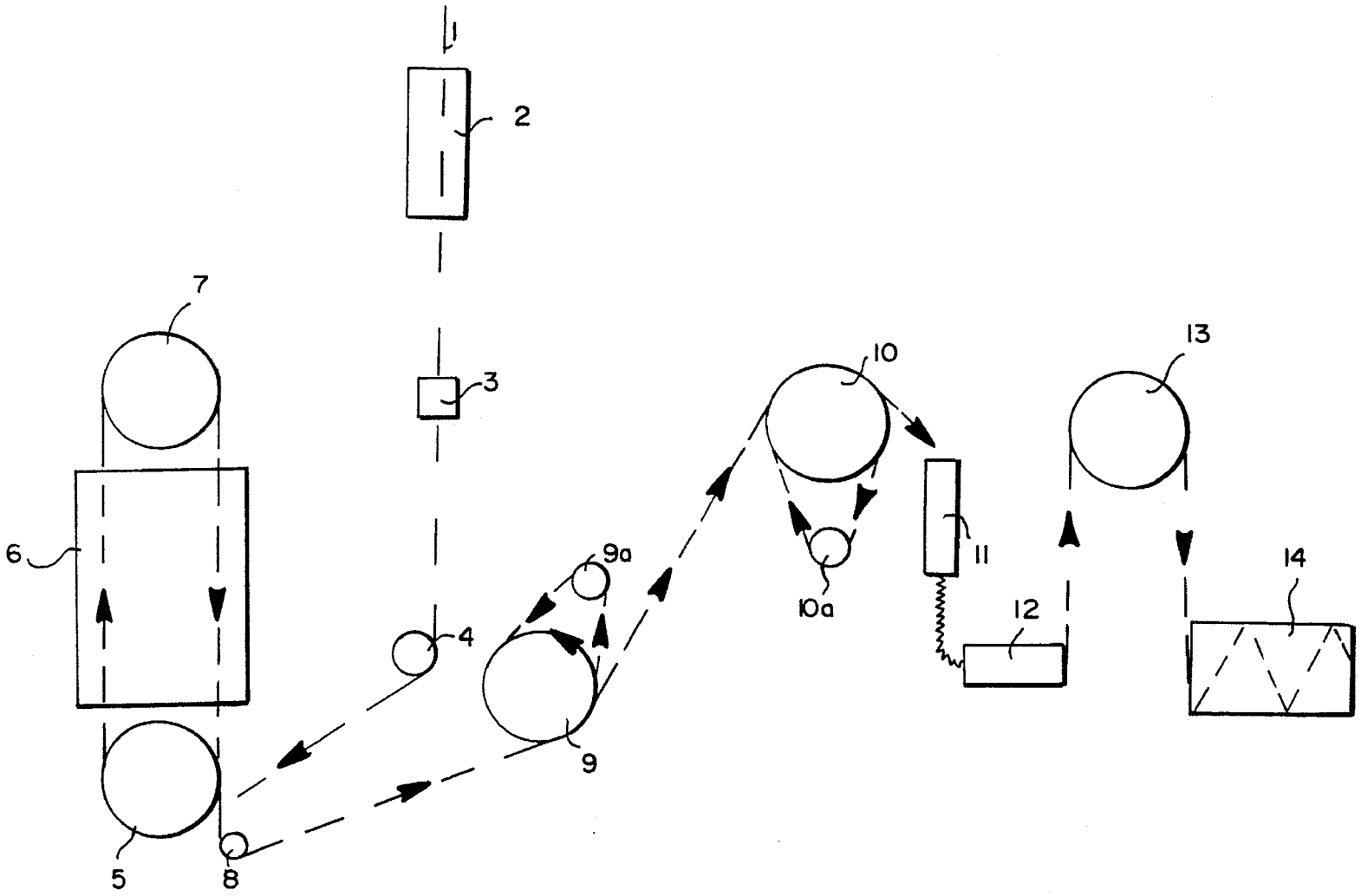
FIG. 1 is a schematic drawing of the apparatus used for the process of the present invention.

In FIG. 1 the filaments 1, which have been spun by a spinnerette, pass the quenching unit 2, followed by a finish application unit 3. The filaments continue to run over a guide 4 to the steam and heating unit comprising godet 5, which could be heated, steam box 6 and the godet 7 which could be heated. The filaments may pass several wraps (18 in FIG. 2) around the two godets 5,7 and the steam box 6, before continuing to run over the guide 8 to the spinning godet 9, which could be heated and the accompanying idler roll 9*a* and further to the drawing godet 10, which could be heated, with the accompanying idler roll 10*a*.

From the drawing godet 10, the filaments continue to run to the texturing unit 11 followed by a cooling unit 12 over the take-off godet 13 to the take-up unit 14, where the filaments are taken up on a winder.

Figure 2:
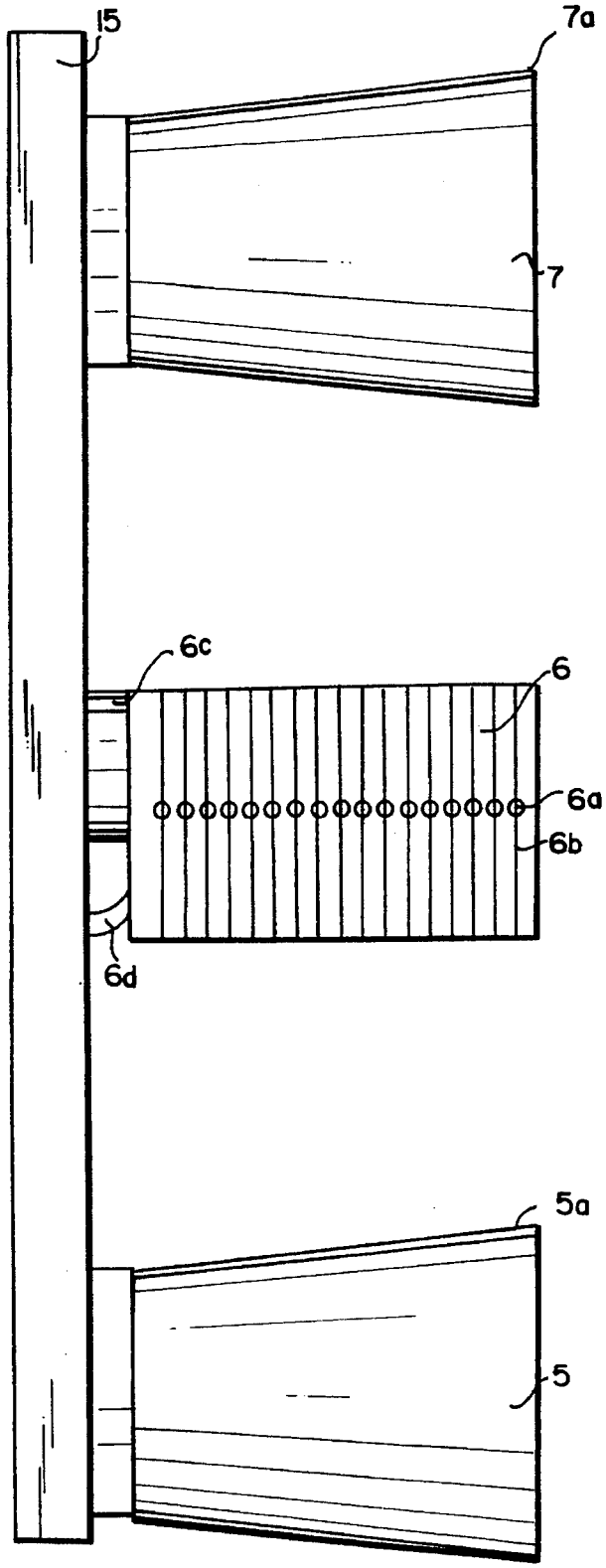
FIG. 2 is a partial schematic drawing of the steam and heating unit comprising two godets, at least one of which is heatable, and a steam box.

FIG. 2 illustrates the steam and heating application unit comprising the stepped-out godets 5 and 7, which could be heated and the steam box 6, all connected to the plate 15. The stepped-out godets 5 and 7 comprise the steps 5*a* and 7*a*. The steam box 6 comprises the steam applicator jets 6*a* which are located inside the slots 6*b*. The steam is fed into the steam box through pipe 6(*c*) and is exhausted through exhaust pipe 6(*d*). Preferably the steam box has the same arrangement on the other side.

EXAMPLE 1

Using the Apparatus shown in FIGS. 1 and 2, nylon 6, with relative viscosity of 2.7 (Ultramid BS-700™ from BASF) chips were melted, extruded and processed under the following conditions:

| | |
|---|---|
| Polymer Temp., °C. | 270 |
| Mass Throughput, grams per minute | 256 |
| Polymer Pressure, psig | 2000 |
| Finish Type | formulation of vegetable oils, alkoxylated diacids, and phosphate esters |
| Finish Level, % | 1.5 |
| Entry (first step) Speed of Godets 5 and 7 in FIGS. 1 and 2, meters per minute | 800 |
| Exit (last step) Speed of Godets 5 and 7 in FIGS. 1 and 2, meters per minute | 936 |
| Temperature of Godets 5 and 7 in FIGS. 1 and 2, °C. | varied during testing: ambient, 90, 125, 140, and 150 |
| Steam Pressure in steam box 6 in FIGS. 1, and 2, psig | varied during testing: off, 53 |
| Steam Temperature in steam box 6 in FIGS. 1 and 2, °C. | varied during testing: off, 140 |
| Spinning Godet Speed, MPM | varied: 800 for control and 960 with steam box |
| Spinning Godet Temperature, °C. | varied: 50 for control and 80 with steam box |
| Drawing Godet Speed, MPM | 2400 |
| Drawing Godet Temperature, °C. | 185 |
| Text. Jet Steam Temp., °C. | 190 |
| Text. Jet Steam Pres., psig | 85 |
| Take Off Godet Speed, MPM | 2130 |
| Take Off Godet Temp., °C. | ambient |
| Winding Speed, MPM | 2020 |
| Winding Tension, grams | 100 |

EXAMPLE 2

Like example 1 except that the finish type was an aqueous emulsion of esters, vegetable oils, alkoxylated vegetable oils, alkoxylated alkyl phenols, and phosphate esters.

EXAMPLE 3 CONTROL

Like example 1 without any steam and heat treatment.

EXAMPLE 4 CONTROL

Like example 2 without any steam and heat treatment.

EXAMPLE 5 CONTROL

Nylon 6 chips are processed in a conventional two-step spinning and drawing process.

TABLE

PROPERTIES OF STEAM BOX TREATED SDT YARN vs. CONTROLS
STEAM/HEAT UNIT

| EXAMPLE | FINISH TYPE | GODET 5 & 7 TEMP °C. | STEAM PRESSURE (psi) | STEAM TEMP. °C. | DENIER | % ELONG | TENACITY (gpd) |
|---|---|---|---|---|---|---|---|
| 1 | Neat | 150 | 53 | 140 | 1272* | 34.6 | 2.42 |
| 2 | Emulsion | 150 | 53 | 140 | 1097 | 30.3 | 2.36 |
| 3 Control | Neat | — | — | — | 1111 | 40.0 | 3.36 |
| 4 Control | Emulsion | — | — | — | 1084 | 36.7 | 2.88 |
| 5 Control | Emulsion | — | — | — | 1111 | 44.0 | 2.05 |

| EXAMPLE | 129° C. SUPER-BA % | 117° C. SUPER-BA % | DENSITY (g/cc) | TYPE OF CRYSTALS % ALPHA | TYPE OF CRYSTALS % GAMMA | TOTAL % CRYSTALLINITY |
|---|---|---|---|---|---|---|
| 1 | 18 | — | 1.128 | 85 | 15 | 43 |
| 2 | 17 | 10 | 1.133 | 95 | 5 | 47 |
| 3 Control | 25 | 17 | 1.127 | 63 | 37 | 42 |
| 4 Control | 28 | 19 | 1.127 | 64 | 36 | 42 |
| 5 Control | 15 | 6 | 1.141 | 96 | 4 | 53 |

*1300 denier target

We claim:

1. A continuous process for spinning and drawing polyamide filaments comprising the steps of:

(a) melting a polyamide and spinning filaments from the molten polyamide through a spinnerette;

(b) quenching the filaments;

(c) applying steam and heat to the filaments in a steam and heat unit by (i) passing the filaments along a looped path over and between a separated pair of godets, (ii) bringing the filaments passing along said looped path into proximity with a steam box positioned at a location between said separated pair of godets, (iii) directing steam from said steam box and onto the filaments in proximity therewith, and (iv) heating at least one of said godets so as to apply heat to the filaments passing thereover; and (d) drawing the filaments.

2. The process according to claim 1, further comprising the step of:

(f) texturing the filaments.

3. The process according to claim 1, wherein step (c)(iv) is practiced by heating each of said pair of godets so as to apply heat to the filaments passing thereover.

4. The process according to claim 1, wherein said godet is a stepped-out godet.

5. The process according to claim 1, wherein the steam has a temperature of from about 60° C. to about 180° C.

6. The process according to claim 1, wherein the steam has a temperature of from about 100° C. to about 150° C.

7. The process according to claim 1, wherein the steam has a temperature of from about 120° C. to about 140° C.

8. The process according to claim 1, wherein said at least one godet has a temperature of from about 60° C. to about 180° C.

9. The process according to claim 1, wherein said at least one godet has a temperature of from about 100° C. to about 160° C.

10. The process according to claim 1, wherein said at least one godet has a temperature of from about 120° C. to about 160° C.

11. The process according to claim 1, wherein the residence time of said filaments in the steam and heat unit is from about 1 to about 9 seconds.

12. The process according to claim 1, wherein the residence time of said filaments in the steam and heat unit is from about 2 to about 4 seconds.

13. An apparatus for the continuous spinning and drawing of polyamide filaments, which comprises:

(i) an extruder connected to a spinnerette for extruding molten polyamide through the spinnerette and thereby spin polyamide filaments;

(ii) means for quenching the extruded filaments;

(iii) means for applying a yarn finish to the filaments;

(iv) means for applying steam and heat to the filaments; and (v) means for drawing the filaments; wherein said means for applying steam and heat is a steam and heating unit which includes (a) a pair of separated godets defining a looped path therebetween along which said quenched polyamide filaments are guided, at least one of said godets being a heated godet, (b) a steam box having steam applicator jets positioned between said pair of separated godets so that said polyamide filaments passing along said looped path are brought into proximity with said steam box, and (c) a steam-supply system for supplying steam to said steam applicator jets so that steam is applied to said polyamide filaments passing along said looped path in proximity with said steam box.

14. The apparatus according to claim 13, wherein each of said godets are heated.

15. The apparatus according to claim 13, wherein at least one godet of said pair of separated godets is a stepped-out godet.

16. The apparatus according to claim 14, wherein said stepped-out godet has from about 5 to about 30 steps.

17. The apparatus according to claim 14, wherein the difference in diameter from step to step of said stepped-out godet is from about 0.2 to about 10%.

18. The apparatus according to claim 15, further comprising a second stepped-out godet, which could be heated and which has from about 1 to about 50 steps.

19. The apparatus according to claim 15, wherein the steam box has a plurality of steam applicator jets on both sides of said steam box so that the filaments pass the jets.

20. The process according to claim 1, wherein step (c) includes wrapping a plurality of turns of said polyamide filaments around each of said godets such that each turn is in proximity to the steam box.

21. The process according to claim 1 or 20, wherein step (c) includes directing steam into an interior of said steam box, and then through steam applicator jets on said steam box.

22. The process according to claim 21, wherein step (c) includes aligning the polyamide filaments which are in proximity to said steam box with said steam applicator jets.

23. An apparatus for steam treating filaments comprising:

(a) a pair of separated godets defining a looped path therebetween along which filaments are guided;

(b) a steaming device having steam applicator jets, said steaming device being positioned between said pair of separated godets so that said filaments passing along said looped path are brought adjacent to said steaming device; and (c) a steam-supply system for supplying steam to said steam applicator jets so that steam is applied thereby to said filaments passing along said looped path adjacent to said exterior surface of said steaming device.

24. Apparatus as in claim 23 wherein said steaming device includes a plurality of slots which are co-located with respective ones of said steam applicator jets.

25. Apparatus as in claim 23 or 24, wherein said steam-supply system includes a steam supply line and an exhaust line fluid-connected to said steaming device.

26. Apparatus as in claim 13 or 23, further comprising mounting structure for mounting said pair of godets and said steaming device as a unit.

27. Apparatus as in claim 23, wherein at least one of said godets is heated.

28. A method for steam treating filaments comprising the steps of:

(a) passing the filaments along a looped path over and between a pair of separated godets;

(b) bringing the filaments passing along said looped path adjacent to a steaming device which is positioned between said pair of separated godets within said looped path; and (c) directing steam from said steaming device onto the filaments adjacent thereto.

29. The method as in claim 28, wherein step (c) includes directing steam through steam applicator jets of said steaming device.

30. The method as in claim 29, wherein step (c) includes guiding said filaments in slots formed in said steaming device and co-located with respective ones of said applicator jets.

31. The method as in claim 28, which further comprises (b) heating at least one of said godets so as to apply heat to the filaments passing thereover.

* * * * *